US011458595B2

(12) United States Patent
Tchakarov et al.

(10) Patent No.: US 11,458,595 B2
(45) Date of Patent: Oct. 4, 2022

(54) TOOL ATTACHMENT MEANS FOR POWER TROWELS

(71) Applicant: HUSQVARNA AB, Huskvarna (SE)

(72) Inventors: Tchavdar V. Tchakarov, Monroe, MI (US); Martin Renneson, Walhain (BE)

(73) Assignee: HUSQVARNA AB, Huskvarna (SE)

( * ) Notice: Subject to any disclaimer, the term of this patent is extended or adjusted under 35 U.S.C. 154(b) by 864 days.

(21) Appl. No.: 16/194,879

(22) Filed: Nov. 19, 2018

(65) Prior Publication Data

US 2020/0156214 A1 May 21, 2020

(51) Int. Cl.

| | |
|---|---|
| ***B24D 9/08*** | (2006.01) |
| ***B24B 7/18*** | (2006.01) |
| ***B24B 41/047*** | (2006.01) |
| ***E04F 21/24*** | (2006.01) |

(52) U.S. Cl.

CPC ..... *B24D 9/085* (2013.01); *B24B 7/186* (2013.01); *B24B 41/047* (2013.01); *E04F 21/248* (2013.01)

(58) Field of Classification Search

CPC ..... B24B 41/00; B24B 55/06; B24B 9/085; B24B 7/186; B24B 41/047; B24B 11/02; B24B 7/063; B24B 7/06; B24B 7/16; B24B 7/18; B24B 7/08; B24B 7/0475; E04F 21/248; E04F 21/21245; E04F 21/247

USPC ..... 451/490, 353, 359, 494, 350, 548

See application file for complete search history.

(56) References Cited

U.S. PATENT DOCUMENTS

| | | | | |
|---|---|---|---|---|
| 2,717,437 | A * | 9/1955 | De Mestral | D03D 27/00 428/92 |
| 3,683,567 | A | 8/1972 | Ali | |
| 4,222,204 | A * | 9/1980 | Benner | B24D 9/085 15/230 |
| 6,089,963 | A | 7/2000 | Wiand et al. | |
| 6,394,887 | B1 * | 5/2002 | Edinger | B24B 23/02 451/490 |
| 7,713,109 | B2 | 5/2010 | Estes | |
| 7,815,393 | B2 | 10/2010 | Snyder et al. | |

(Continued)

FOREIGN PATENT DOCUMENTS

| | | | |
|---|---|---|---|
| AT | 16008 | U1 | 10/2018 |
| CN | 2928377 | Y | 8/2007 |

(Continued)

OTHER PUBLICATIONS

WEN. "WEN 6377 Variable Speed 5-Amp Dual-Head Drywall Sander with 15-Foot Hose" (Jul. 19, 2017). Amazon.com (Year: 2017).*

(Continued)

*Primary Examiner* — Joseph J Hail
*Assistant Examiner* — Timothy Brady
(74) *Attorney, Agent, or Firm* — Burr & Forman LLP

(57) ABSTRACT

A tool driver for a power trowel, the tool driver comprising a combination of a magnetic fastening arrangement and a hook and loop based fastening arrangement for releasably holding an abrasive tool to the tool driver, wherein the magnetic fastening arrangement is configured symmetrically around a rotational center of the tool driver, wherein the hook and loop based fastening arrangement is adapted to provide increased shear strength during abrasive operation of the tool, and wherein the magnetic fastening arrangement is adapted to provide increased pull strength during lifting of the tool driver.

20 Claims, 5 Drawing Sheets

(56) References Cited

U.S. PATENT DOCUMENTS

| | | | | |
|---|---|---|---|---|
| 8,272,924 | B2 | 9/2012 | Van Eijden et al. | |
| 8,408,974 | B2 | 4/2013 | Farber et al. | |
| 8,827,278 | B2 | 9/2014 | Chen et al. | |
| 9,314,899 | B2 | 4/2016 | Puchegger et al. | |
| 9,969,053 | B2 | 5/2018 | Lee et al. | |
| 10,299,653 | B2 | 5/2019 | LaBarbera et al. | |
| 10,449,651 | B2 * | 10/2019 | Stark | B24D 5/16 |
| 2006/0150428 | A1 | 7/2006 | Baculy | |
| 2007/0093190 | A1 | 4/2007 | Schomisch | |
| 2009/0191376 | A1 | 7/2009 | Rivard et al. | |
| 2011/0223845 | A1 | 9/2011 | Van Der Veen et al. | |
| 2012/0270483 | A1 | 10/2012 | Bae et al. | |
| 2015/0328739 | A1 | 11/2015 | Rogers et al. | |
| 2016/0136772 | A1 | 5/2016 | Littlefield et al. | |
| 2017/0259391 | A1 | 9/2017 | Viebahn et al. | |
| 2018/0200857 | A1 | 7/2018 | Tchakarov | |
| 2018/0333820 | A1 | 11/2018 | Stark et al. | |
| 2021/0317669 | A1 * | 10/2021 | Wagman, III | E04F 21/163 |

FOREIGN PATENT DOCUMENTS

| | | | | |
|---|---|---|---|---|
| CN | 202411986 | U | 9/2012 | |
| CN | 205685124 | U | 11/2016 | |
| CN | 208099982 | U | 11/2018 | |
| DE | 4444496 | A1 | 6/1996 | |
| DE | 202011101564 | U1 | 11/2011 | |
| DE | 102014100900 | A1 | 7/2015 | |
| DE | 102014100900 | A1 * | 7/2015 | B24B 45/006 |
| EP | 557773 | B1 | 5/1998 | |
| EP | 2428314 | A2 | 3/2012 | |
| EP | 2915630 | B1 | 1/2017 | |
| EP | 3184243 | A1 | 6/2017 | |
| EP | 3216561 | A1 | 9/2017 | |
| WO | WO-2011008077 | A1 * | 1/2011 | B24D 7/066 |
| WO | 2011074773 | A2 | 6/2011 | |
| WO | 2014055031 | A1 | 4/2014 | |

OTHER PUBLICATIONS

English Translation of DE 10 2014 100 900 (Year: 2014).*

International Search Report and Written Opinion for International Application No. PCT/EP2019/067196 dated Oct. 22, 2019.

* cited by examiner

TOOL ATTACHMENT MEANS FOR POWER TROWELS

TECHNICAL FIELD

The present disclosure relates to power trowels and to machines in general for levelling and polishing concrete surfaces such as floors and the like. There are disclosed means for attaching abrasive tools to one or more power trowel tool drivers, in particular flexible abrasive tools.

BACKGROUND

Trowel polishing is a new trend in the construction industry. Trowel polishing comprises use of abrasive tools, e.g., diamond tools, for smoothing and polishing large concrete surfaces such as flooring and the like. Similar equipment can also be used for polishing stone and marble surfaces, although concrete is the most common.

A power trowel, also known as a "power float", is a piece of construction equipment used by construction companies and contractors to apply a smooth finish to concrete slabs. Power trowels differ in the way they are controlled;

Walk-behind power trowels are used by an operator walking behind the machine.

Ride-on power trowels are used by an operator sitting on a seat upon the machinery, controlling the power trowel with control means.

A hand tool for the same task is often referred to as a concrete float. A float is used after the surface has been made level using a screed. In addition to removing surface imperfections, floating will compact the concrete as preparation for further processing steps.

Power trowels use abrasive tools held by tool drivers for abrading surfaces. The tool driver is rotatably attached to a motor which powers the tool driver, and the tool is then attached to the tool driver for abrasive operation.

The abrasive tools used by the power trowel are replaced regularly by, e.g., tools having finer and finer grit size, and also as they are worn out. Thus, the tools are preferably arranged releasably held by the tool driver of the power trowel to facilitate replacement. The tools need to be held firmly enough such that they are not accidentally released during abrasive operation, but not too firmly since this would make tool replacement inconvenient.

There is a need for abrasive tools and corresponding tool drivers which facilitate tool replacement while at the same time providing sufficient support for an efficient abrading operation.

SUMMARY

It is an object of the present disclosure to provide abrasive tools and tool drivers which facilitate tool replacement and at the same time provide for efficient and robust abrading operation without accidental tool release.

This object is at least in part obtained by a tool driver for a grinder, power trowel, or other planetary grinding system. The tool driver comprises a combination of a magnetic fastening arrangement and a hook and loop based fastening arrangement for releasably holding an abrasive tool to the tool driver. The magnetic fastening arrangement is configured symmetrically around a rotational center of the tool driver. The hook and loop based fastening arrangement is adapted to provide increased shear strength during abrasive operation of the tool, while the magnetic fastening arrangement is adapted to provide increased pull strength during lifting of the tool driver.

Thus, advantageously, both pull strength and shear strength are provided by the combination of fastening arrangements, while allowing for convenient tool replacement.

The hook side and the loop side can be arranged on any of the tool driver or the tool, allowing for flexibility in manufacturing, which is an advantage.

The disclosed techniques are particularly suitable for use with non-rigid tools, i.e., tools comprising a flexible supporting element for holding an abrasive compound, such as fibrous pads and the like.

According to aspects, the magnetic fastening arrangement comprises a plurality of magnets arranged symmetrically around a rotational center of the tool driver.

Consequently, the tool can be rotated relative to the tool driver while maintaining pull strength. This simplifies tool replacement in that the tool need not be attached at any particular angle with respect to the tool driver.

According to other aspects, the magnetic fastening arrangement comprises a metal element responsive to a magnetic force from the abrasive tool.

The magnetic fastening arrangement can be implemented with any combination of metal elements and magnets, which is an advantage. The metal element can, e.g., be a ring of metal having a diameter smaller than a diameter of the tool driver. This saves cost since a smaller ring is used.

According to aspects, the tool driver comprises centering means for centering the abrasive tool with respect to the rotational center of the tool driver.

The centering means further simplifies tool replacement, since no trial and error is required during tool alignment, which is an advantage.

The object is also obtained by an abrasive tool for a grinder, power trowel, or other planetary grinding system. The abrasive tool comprises a combination of a magnetic fastening arrangement and a hook and loop based fastening arrangement for being releasably held by a tool driver. The magnetic fastening arrangement is configured symmetrically around a rotational center of the tool. The hook and loop based fastening arrangement is adapted to provide increased shear strength during abrasive operation of the tool, and wherein the magnetic fastening arrangement is adapted to provide increased pull strength during lifting of the tool.

The abrasive tool is configured for operation together with the tool driver and is associated with the same advantages as the tool driver.

A loop side on the abrasive tool may according to some aspects be implemented by a fibrous material, such as a felt-like cloth or similar fibrous material, which is a cost-effective way of producing the tool. This fibrous material is, according to aspects, a flexible supporting element for holding the abrasive compound. It is noted that this type of felt-like cloth or fibrous material is different from the known Velcro loop-side that is a synthetic material comprising a special type of loops.

The disclosed tools are flexible and/or resilient, i.e., compressible to some extent, and of sufficient strength. The fibrous tools made from felt, thick fabrics, and the like are possible to wash in water, and also cost effective.

There are also disclosed herein construction equipment, grinders, power trowels, and methods associated with the above-mentioned advantages.

BRIEF DESCRIPTION OF THE DRAWINGS

The present disclosure will now be described in more detail with reference to the appended drawings, where FIGS. 1-2 schematically illustrate power trowels.

DETAILED DESCRIPTION

Figure 1:
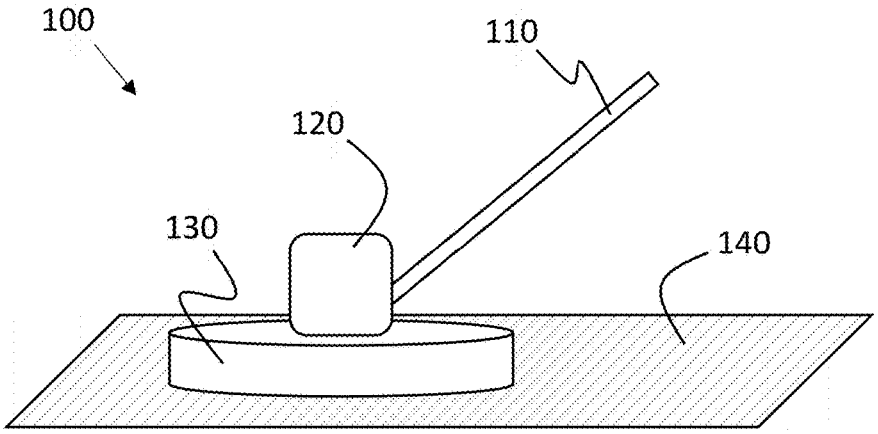

Aspects of the present disclosure will now be described more fully hereinafter with reference to the accompanying drawings. The different devices and methods disclosed herein can, however, be realized in many different forms and should not be construed as being limited to the aspects set forth herein. Like numbers in the drawings refer to like elements throughout.

The terminology used herein is for describing aspects of the disclosure only and is not intended to limit the invention. As used herein, the singular forms "a", "an" and "the" are intended to include the plural forms as well, unless the context clearly indicates otherwise.

Herein, a rotational center is a point on an object which stays fixed as the object is rotated. It is appreciated that objects which are not designed to rotate during operation still have rotational centers. For instance, the rotational center of any disc-shaped object coincides with the center of the disc. The rotational center of a square object also coincides with the center of the square object.

Figure 2:
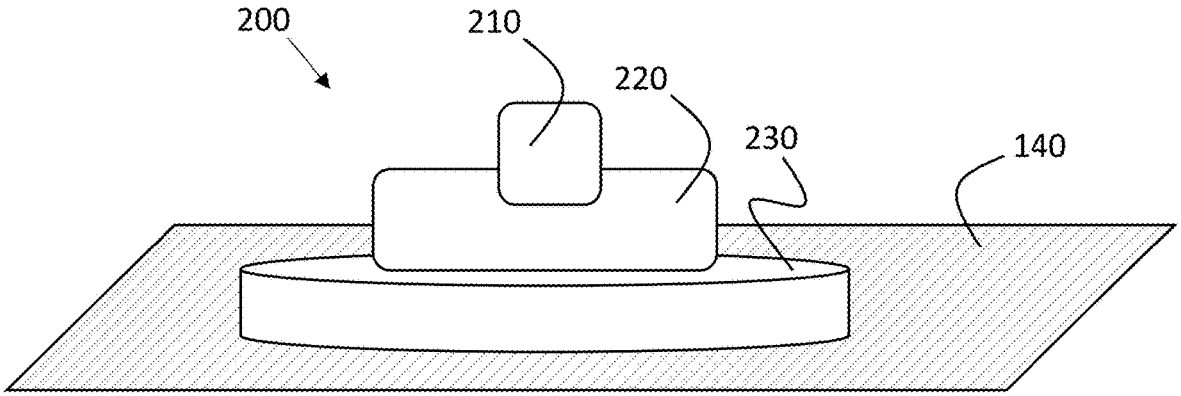

FIGS. 1 and 2 schematically illustrate power trowels 100, 200 for abrading, levelling and/or polishing surfaces 140, such as concrete surfaces. The power trowel 100 is a walk-behind power trowel while the power trowel 200 is a ride-on power trowel.

The walk-behind power trowel 100 comprises a handle 110 which the operator uses to guide the trowel. There is a power source 130, a combustion engine or electrical motor, which powers the trowel 130.

The ride-on power trowel 200 has a seat with control means 210 where an operator sits and controls the power trowel 200. There is again a power source 220 which powers the trowel 230.

Power trowels in general are known and will not be discussed in more detail here.

The abrasive tools disclosed herein comprise an abrasive component or compound arranged on a side of the abrasive tool opposite to the side which attaches to the tool driver. Thus, an abrasive operation is performed when the tool is rotated or otherwise brought in non-stationary contact with a material to be abraded.

The abrasive component may be realized in many different ways; for instance, abrasive coins may be bonded to a ring, such as a plastic ring, which is glued to the tool. An abrasive compound can be sprayed onto the tool and bonded thereon by a resin. The pad itself may also be impregnated by a compound comprising, e.g., diamond particles or the like.

Herein, a tool driver may also be referred to as a tool holder. It is appreciated that a tool driver need not necessarily be arranged to rotate about its own center. Rather, a tool driver may be fixedly attached to an arm which is rotating around some other center of rotation.

The disclosed techniques can be used for abrasive operation by a wide variety of different tools and construction equipment, such as single disc grinders, passive planetary systems, and active planetary systems. The disclosed tools and tool drivers are especially suited or use with power trowels but can also be used with other surfacing machines such as floor cleaning machines and floor polishing machines.

Figure 3:
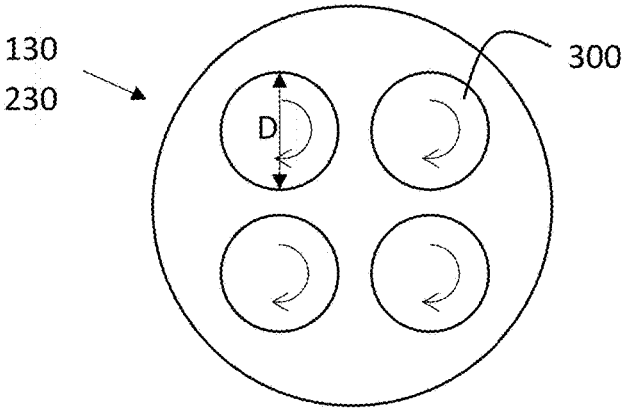
FIG. 3 shows an example tool configuration for a power trowel.

FIG. 3 shows an example tool configuration for a power trowel. A power trowel may comprise one or more such tool configurations, e.g., 1, 2, or even 4. The trowels 130, 230 comprise tool drivers 300 to which abrasive tools can be releasably held. Power trowels commonly comprise between 8-12 abrasive tools. The abrasive tools are often disc-shaped with a diameter of 14". However, tool diameters from 7-25 inches may be used with the disclosed techniques.

Known tool drivers comprise hook-and-loop systems for releasably holding the abrasive tool.

Hook-and-loop fasteners, hook-and-pile fasteners or touch fasteners (often referred to by the genericized trademark Velcro), consist of two components: typically, two fabric strips or, alternatively, round "dots" or squares which are attached (glued, riveted, sewn or otherwise adhered) to the opposing surfaces to be fastened. The first component features tiny hooks, the second features smaller loops. When the two are pressed together the hooks catch in the loops and the two pieces fasten or bind temporarily. When separated, by pulling or peeling the two surfaces apart, the strips make a distinctive "ripping" sound.

Herein, a hook and loop based fastening arrangement is any arrangement which uses the hook and loop principle to releasably hold one element to another element. It is appreciated that hook and loop based fastening arrangements comprise arrangements where hooks are arranged on one element and loops are arranged on the other element, regardless of which element is which. Hook and loop based fastening arrangements also comprise configurations where combinations of hooks and loops are arranged on both elements.

Herein, hook and loop based fastening arrangements also comprise arrangements where the loop side comprises a fibrous material, such as a cloth or felt-like material. It is appreciated that most fibrous materials attach to some extent to a hook side of a hook and loop based fastening arrangement, since the hooks catch on to the fibers in the fibrous material. Such fibrous materials may optionally be used as supporting element for the abrasive compound that performs the abrasive operation of the abrasive tool. Thus, a flexible or at least partly non-rigid tool is provided.

The loop side may also comprise other types of flexible materials, e.g., foam-based materials and rubber.

It has been realized that fastening means based only on hook and loop arrangements provide high resistance to the shear forces exerted on tools during abrasive operation, which is an advantage. However, hook and loop arrangements do not provide very large resistance to the pull forces which are exerted on tools as the trowel is lifted from the surface during tool replacement, especially if the loop-side is constituted by a fibrous material instead of a conventional 'Velcro' loop-side. Such fibrous materials often provide reduced pull strength compared to conventional Velcro-like loop side materials.

A magnetic fastening arrangement, as referred to herein, is any arrangement which is able to releasably hold one element to another element by means of a magnetic force exerted by one or both elements onto the other. Thus, magnetic fastening means comprises arrangements where one element is configured with electromagnetic or permanent magnets while the other element is configured with metal responsive to a magnetic force, such as iron, nickel, cobalt, or certain rare earth metal alloys such as neodymium. Magnetic fastening means also comprises arrangements where both elements are configured with magnets of different polarity, or combinations of magnetic metals and magnets.

It has been realized that fastening means based only on magnetic arrangements are too weak for use with power trowels when it comes to shear force resistance. This means that, during abrasive operation, the tool may slide off the tool driver, which causes interruption of the abrasive operation. However, magnetic fastening means do provide the sought resistance to pull forces which are exerted on the tool as the trowel is lifted from the surface during tool replacement.

The tools and tool drivers disclosed herein comprise a combination of magnetic fastening means and hook-and loop based fastening means, which is an advantage since the combination of fastening means facilitate tool replacement and at the same time provide for efficient and robust abrading operation. The combination of the hook and loop, and magnetic system ensures that the tool is attached with a strong shear resistance and pull-apart strength.

The combination of magnetic fastening means and hook-and-loop based fastening means is especially suited for flexible tools where a fibrous material, such as felt or the like, is used to support the abrasive compound.

As mentioned above, tools and corresponding tool drivers having a diameter between 7 inches and 25 inches are suitable for the disclosed techniques.

A preferred size of the tools and tool drivers disclosed herein is a diameter of 11 inches.

Another preferred size of the tools and tool drivers disclosed herein is a diameter of 14 inches.

It is appreciated that the disclosed techniques are applicable also for larger tools and corresponding tool drivers of up to 48 inches.

There are disclosed herein arrangements 130, 230 for abrasive operation by a grinder such as a power trowel 100, 200 comprising at least one, and preferably a plurality of, tool drivers and a corresponding number of abrasive tools which facilitate tool replacement and at the same time provide for efficient and robust abrading operation.

There are also disclosed power trowels 100, 200 comprising one or more abrasive tools and/or tool drivers as discussed herein.

Figure 4A:
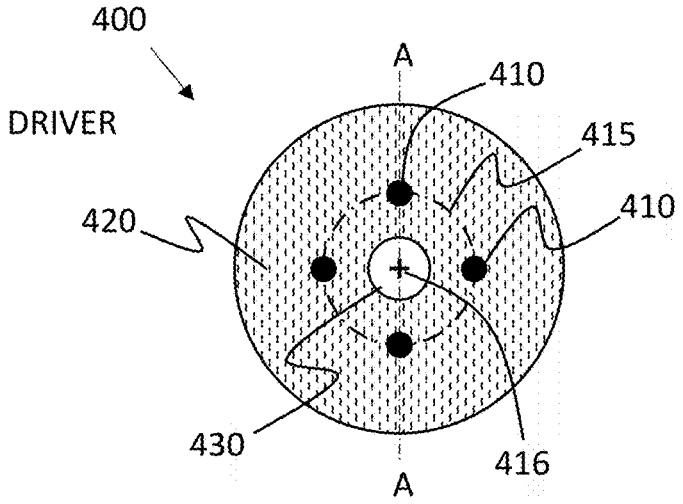
FIGS. 4A and 4B schematically illustrate a tool driver for a power trowel.
Figure 4B:
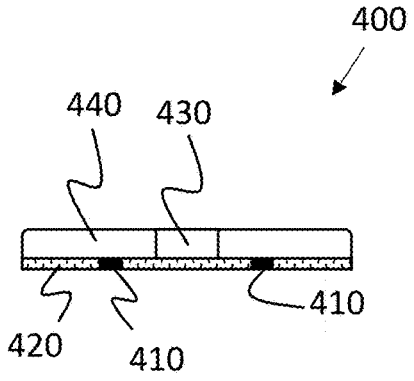

FIGS. 4A and 4B schematically illustrate a tool driver 400 for a power trowel such as the power trowels 100, 200 discussed above. At least one magnet 410, preferably a plurality of magnets, are arranged on the tool driver symmetrically 415 around a rotational center 416 of the tool driver. Here, a hole is shown in the center. It is appreciated that this hole 430 is optional, i.e., not necessary for the overall function as described herein.

The disclosed tool driver and tool combinations are suitable for any planetary grinding system using rotating tools for grinding or polishing surfaces.

There is also a hook component in a hook and loop based fastening system 420 arranged on the tool driver. Here the hooks are shown covering the whole tool driver 400 except for the hole 430, but the hooks can just as well cover only a part of the tool driver.

Consequently, the tool driver 400 shown in FIGS. 4A and 4B comprises a combination of a magnetic fastening arrangement 410 and a hook and loop based fastening arrangement 420 for releasably holding an abrasive tool to the tool driver. The magnetic fastening arrangement 410 is configured symmetrically 415 around a rotational center 416 of the tool driver. It is understood that the magnets are fixedly attached to the tool driver.

It is preferred that the hooks cover a symmetric area centered around the rotation center 416 of the tool driver 400.

FIG. 4B shows a side view along section A-A of the tool driver 400. The combination of magnetic fastening arrangement 410 and hook and loop system 420 is shown. The tool driver also comprises a support structure 440 for attaching to the power source and for providing structural integrity to the tool driver.

As discussed above, the hook and loop based fastening arrangement is adapted to provide increased shear strength during abrasive operation of the tool, while the magnetic fastening arrangement is adapted to provide increased pull strength during lifting of the tool driver. This combination is advantageous in that it facilitates tool replacement at the same time as it provides for a robust abrasive operation without interruptions due to tool loss. It was previously thought that only a hook and loop-based system, was sufficient for this application.

The tool driver 400 comprises the hook side of a hook and loop system, which is a preferred configuration. It is however, appreciated that the tool driver can also comprise the loop side.

Thus, according to some aspects, the hook and loop based fastening arrangement on the tool driver comprises hooks for holding respective loops on the abrasive tool. According to some other aspects, the hook and loop based fastening arrangement on the tool driver comprises loops for holding respective hooks on the abrasive tool. An example of such loops is a fibrous pad.

As mentioned above, the magnetic fastening arrangement may comprise a plurality of magnets 410 arranged symmetrically 415 around a rotational center of the tool driver.

According to other aspects, the magnetic fastening arrangement comprises a metal element which is responsive to a magnetic force from the abrasive tool. The metal element is thus arranged to be releasably held by one or more magnets.

Figure 5A:
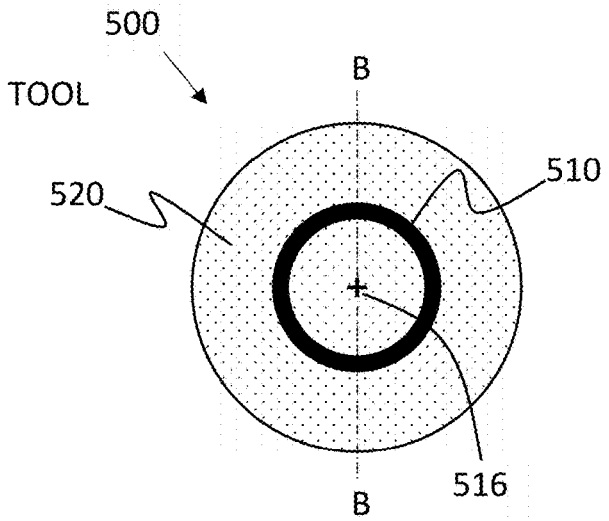
FIGS. 5A and 5B schematically illustrate a tool for a power trowel tool driver.
Figure 5B:
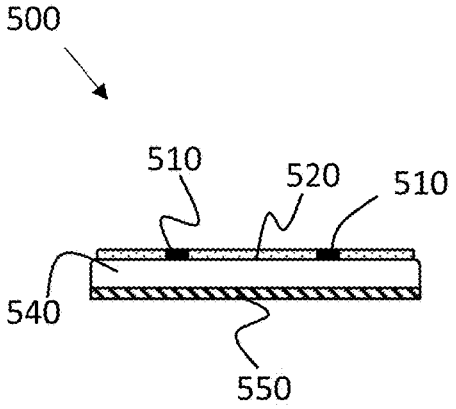

FIGS. 5A and 5B schematically illustrate a tool 500 for a tool driver such as that illustrated in FIG. 5A.

FIG. 5A shows an abrasive tool 500 for a power trowel 100, 200. The abrasive tool comprises a combination of a magnetic fastening arrangement 510 and a hook and loop based fastening arrangement 520 for being releasably held by a tool driver such as the tool driver 400 discussed above. The magnetic fastening arrangement 510 is configured symmetrically around a rotational center 516 of the tool.

FIG. 5B shows a side view of the tool 500 along cross section B-B. The abrasive coating 550 is shown in FIG. 5B, it is this coating that abrades the material which is to be levelled or polished. The tool also comprises a support structure 540 which provides mechanical integrity. The combination of hook and loop-based fastening means 520 and magnetic fastening means 510 can also be seen in FIG. 5B. Again, advantageously, the hook and loop based fastening arrangement 520 is adapted to provide increased shear strength during abrasive operation of the tool, and the magnetic fastening arrangement 510 is adapted to provide increased pull strength during lifting of the tool.

According to aspects, the hook and loop based fastening arrangement on the tool comprises hooks for holding respective loops on the corresponding tool driver.

According to other aspects, the hook and loop based fastening arrangement on the tool comprises loops, e.g., a fibrous pad, for holding respective hooks on the tool driver.

According to some aspects, the abrasive component on the tool is supported at least partly by a flexible supporting element, such as the fibrous pad. Thus, the tool is not necessarily mounted on a rigid supporting element but may flex and bend somewhat to follow irregularities in the material to be abraded.

It is appreciated that the loop side on the abrasive tool may according to some aspects be implemented by a fibrous material, such as a felt-like cloth or similar fibrous material, which is a cost-effective way of producing the tool. It is noted that this type of felt-like cloth or fibrous material is different from the known Velcro loop-side that is a synthetic material comprising a special type of loops. Also, the felt-like cloth or fibrous material constitutes a flexible carrier for an abrasive material, providing a flexible tool.

The configuration of magnetic fastening means in FIG. 5B is a metal band arranged symmetrically around the rotational center 516. It is however, appreciated that magnets can be arranged also on the tool, albeit with a different polarity compared to the corresponding tool driver.

Thus, according to aspects, the magnetic fastening arrangement comprises a plurality of magnets 410 arranged symmetrically around a rotational center of the abrasive tool.

According to other aspects, the magnetic fastening arrangement comprises a metal element responsive to a magnetic force from the tool driver.

A circularly shaped or otherwise rotationally symmetric shaped magnetic tape can optionally be attached to the fibrous pad of the tool to provide magnetic attachment force.

Figure 6:
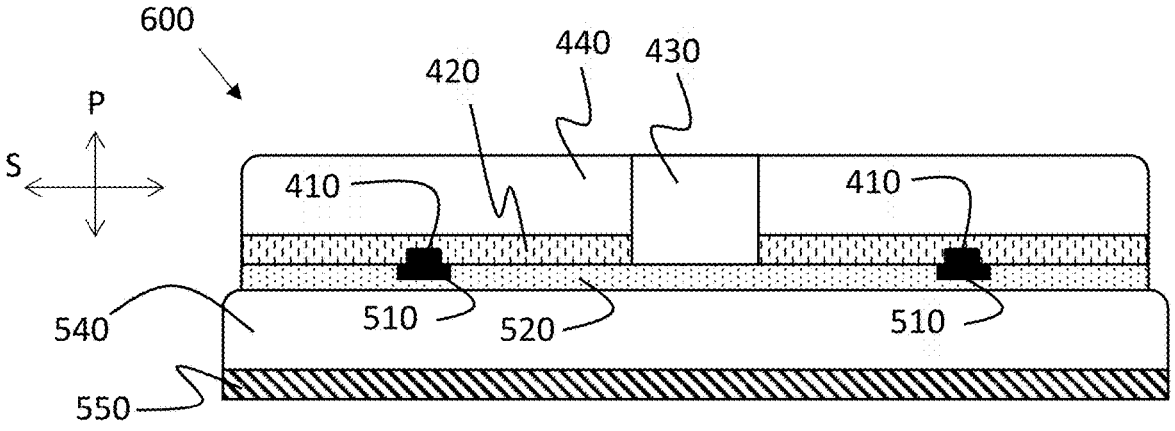
FIG. 6 illustrates a combination of tool and tool driver for power trowels.

FIG. 6 shows a tool and tool driver combination 600. It is seen that the magnets 410 align with the metal band 510. Since both magnets and metal band are arranged symmetrically around the rotational center of the tool and driver, respectively, there is always overlap between magnets and metal band, regardless of in which angle the tool is turned relative to the driver, which is an advantage since it simplifies tool replacement. It is also noted that the elements of the hook and loop based fastening means overlap and thus attach releasably to each other.

FIG. 6 also illustrates the force direction S of the shear forces which act on the tool during abrasive operation, and the gravitational pull forces P which act on the tool when the trowel is lifted from the surface during tool replacement.

Figure 7A:
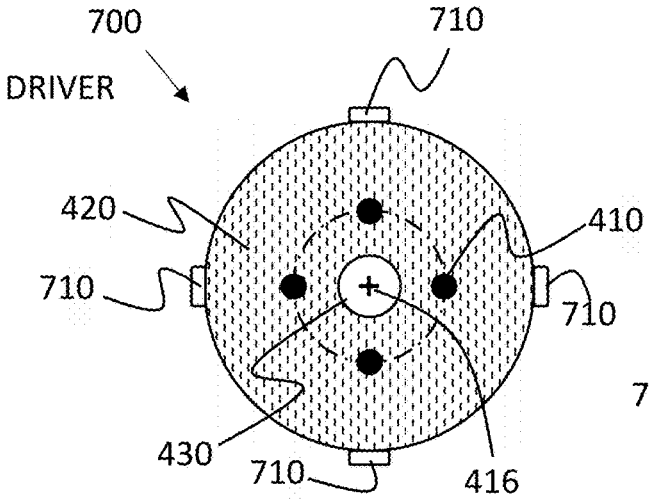
FIGS. 7A, 7B, 8A, 8B schematically illustrate centering means.
Figure 7B:
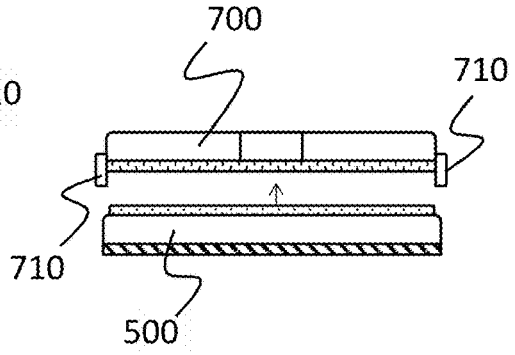

FIGS. 7A and 7B schematically illustrate centering means.

A potential issue relates to a scenario when the tool 800 is not attached centered with respect to the tool driver 800. If the tool center does not align with the tool driver center, then fastening means may not be as effective. For instance, magnets 410 may not contact the metal band 510 with a reduced pull force resistance as consequence.

To alleviate this issue, the tool driver 700 comprises centering means 710 for centering the abrasive tool with respect to the rotational center 416 of the tool driver.

The centering means 710 may comprise centering elements arranged around the circumference of the tool driver as shown in FIG. 7A. The centering elements only allow the tool to contact the tool driver if the rotational centers are aligned, otherwise the tool will not attach. This is an advantage since it simplifies tool replacement and provides for a more robust abrasive operation with a reduction in involuntary tool release.

FIG. 7B shows a side view of the tool driver 700 when receiving a tool 500. The tool 500 will only attach to the driver if it passes the centering means 710, which is an advantage.

Thus, according to aspects, the tools disclosed herein may comprise centering means 810 for centering the abrasive tool with respect to a rotational center 416 of the tool driver.

Figure 8A:
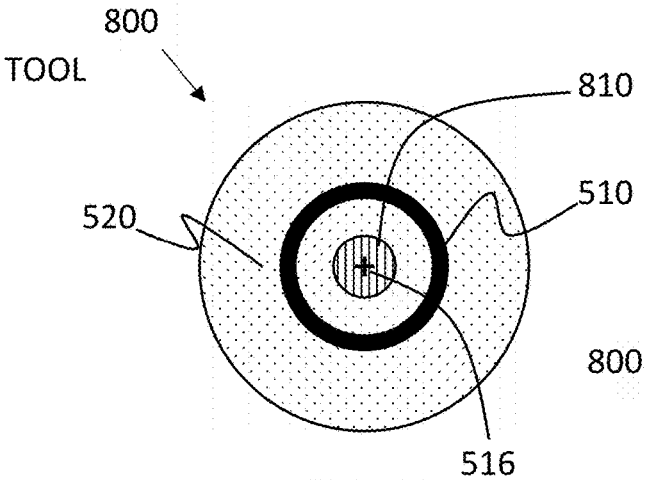
Figure 8B:
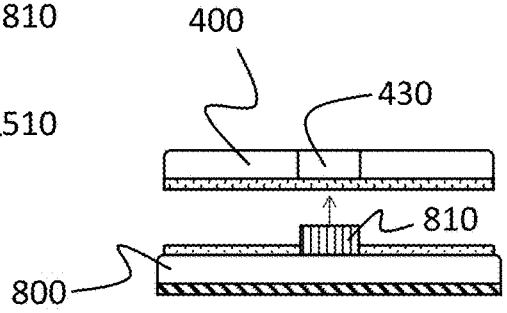

FIGS. 8A and 8B schematically illustrate other example centering means. Here, a tap 810 is arranged protruding from the tool 800. The tap is configured to be received in a corresponding hole 430 in the tool driver 400.

FIG. 8B illustrates the tool 800 being attached to a tool driver 400. Only when the centering means enters the hole 430 can the tool 800 attach to the driver 400.

The tap arrangements and centering element arrangements can be used in combination for additional centering robustness.

It is appreciated that the magnetic fastening means discussed above are also providing a centering function, since the magnets will exert a magnetic force only when aligned with the corresponding magnetic fastening element on the tool or tool driver. Thus, a centering action by the magnets follow from the rotationally symmetric configuration of the magnetic fastening means.

Figure 9:
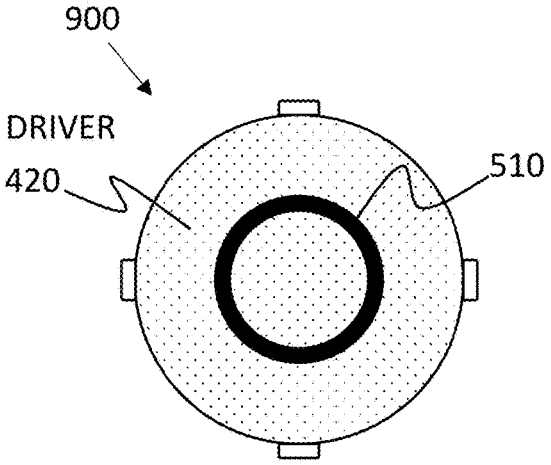
FIG. 9 schematically illustrates a tool driver for a power trowel.

FIG. 9 schematically illustrates a tool driver 900 for a power trowel. This tool driver comprises the loop component 420 of the hook and loop based fastening means. It is this appreciated that the hook and loop based fastening means can be arranged in different ways while maintaining the technical effects discussed herein.

The tool driver 900 also comprises a metal band 520 instead of magnets, this illustrates that magnets and metal band can be exchanged or switched between tool and tool driver while maintaining the technical effects discussed herein.

Figure 10:
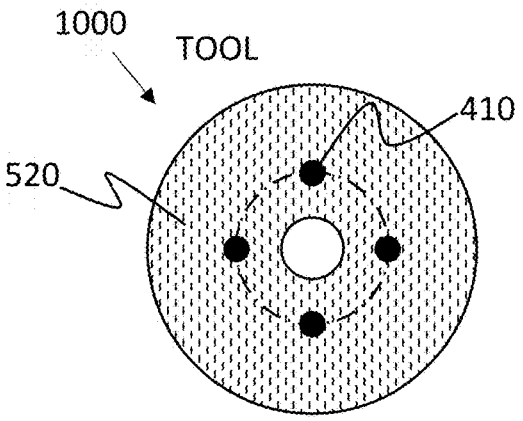
FIG. 10 schematically illustrates a tool for a tool driver.

FIG. 10 schematically illustrates a tool 1000 for a tool driver. This tool comprises the hook element 520 of the hook and loop based fastening arrangement, and also the magnets 410. The tool 1000 therefore corresponds to and can be releasably held by the tool driver 900.

Figure 11:
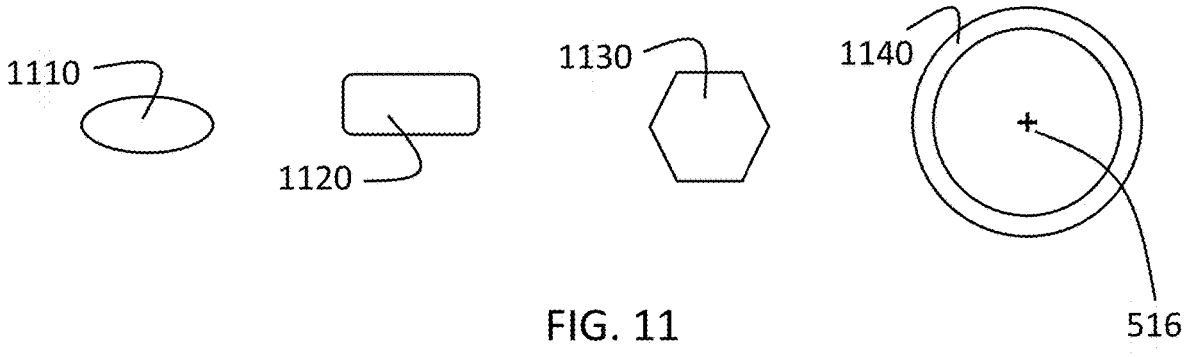
FIG. 11 shows a collection of example magnet shapes.

FIG. 11 shows a collection of example magnet shapes 1110, 1120, 1130, 1140. It is appreciated that magnets can have varying shape and can also be applied as a band 1140 around the rotational center of any of the tool or the tool driver.

Figure 12:
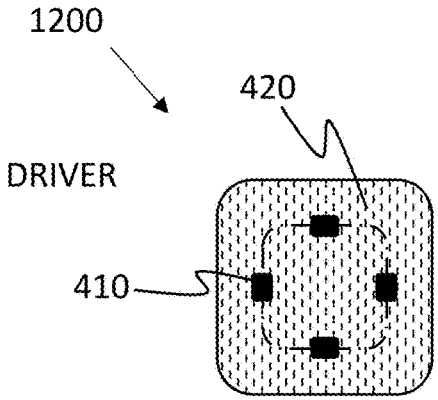
FIG. 12 schematically illustrates a tool driver for a power trowel.

FIG. 12 schematically illustrates a tool driver 1200 for a power trowel. This tool driver has a rectangular shape which may be advantageous in some polishing scenarios.

Figure 13:
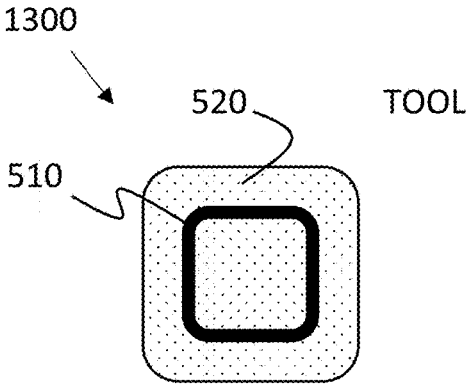
FIG. 13 schematically illustrates a tool for a power trowel tool driver.

FIG. 13 schematically illustrates a tool 1300 corresponding to the tool driver 1200.

Figure 14:
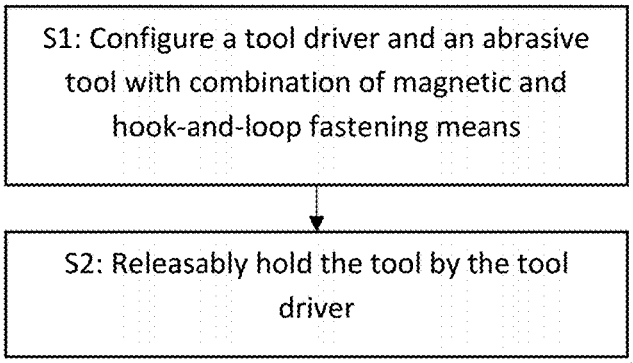
FIG. 14 is a flow chart illustrating methods.

FIG. 14 is a flow chart illustrating methods. There is shown a method of attaching a tool 500, 800, 1000, 1300 to a tool driver 400, 700, 900, 1200 for a power trowel 100, 200. The method comprises configuring S1 a combination of a magnetic fastening arrangement 410, 510 and a hook and loop based fastening arrangement 420, 520 for releasably holding an abrasive tool 500, 800, 1000, 1300 to the tool driver, wherein the magnetic fastening arrangement 410, 510 is configured symmetrically 415 around a rotational center 416 of the tool driver. The method also comprises releasably holding S2 the tool by the tool driver.

Figure 15A:
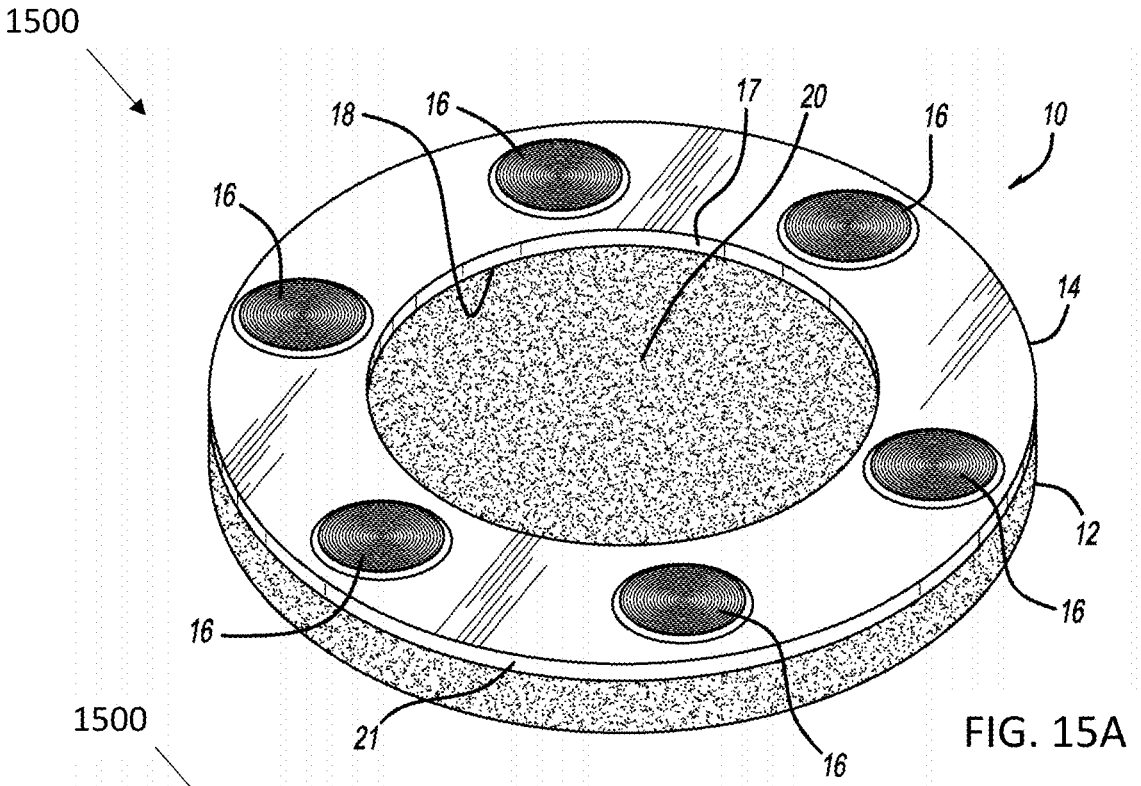
FIGS. 15A and 15B schematically illustrate a tool for a power trowel.
Figure 15B:
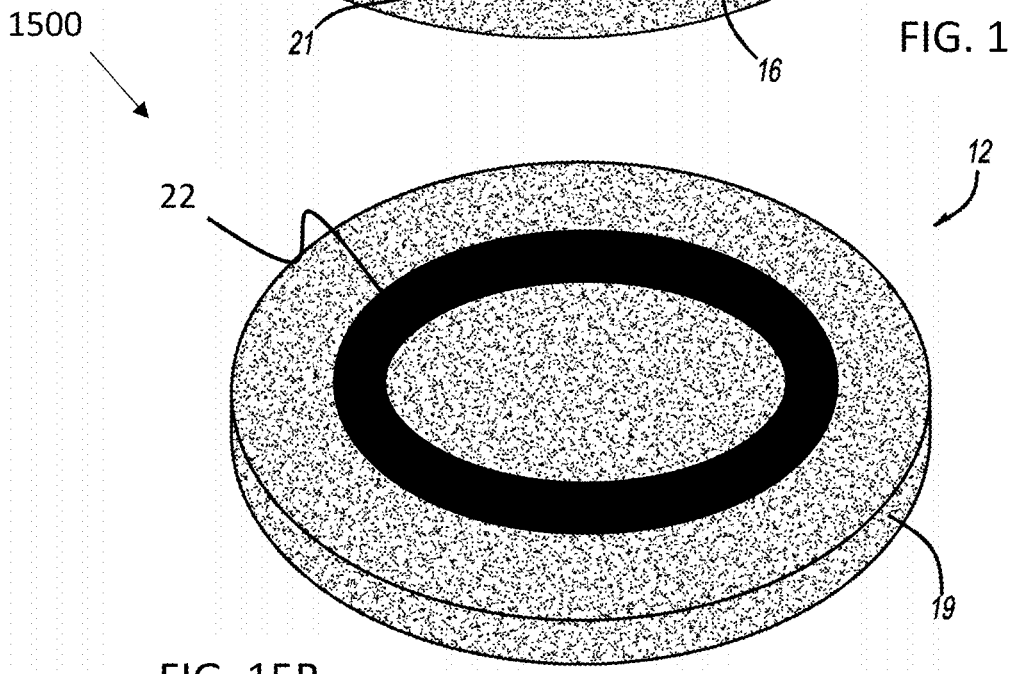

FIGS. 15A and 15B schematically illustrate a tool for a power trowel. The tool is, according to aspects, a pad assembly 10 such as that exemplified in FIGS. 15A-15B. Pad assembly 10 may be used for grinding or polishing composite surfaces, such as concrete. Pad assembly 10 includes a wear-resistant base pad 12, which may be a porous, fibrous, flexible, and deformable material, including natural and/or artificial fibres. Base pad 12 is generally circular, having a diameter and a thickness. Of course, base pad 12 could be made in other sizes.

A reinforcement ring or layer 14 is secured to one side of base pad 12, such as by adhesive. The reinforcement ring 14 is generally annular having a central opening 18 with a diameter (for example, approximately 8 inches). Reinforcement ring 14 may be a rigid rubber or plastic having a thickness greater than zero and up to 0.125 inch. Reinforcement ring or layer 14 reinforces and adds some stiffness and toughness to the outer portion of pad 12, however, ring or layer 14 allows some flexibility to pad assembly 10 so it can flex with and follow any floor imperfections thereby producing uniform floor contact for polishing or grinding.

A circular internal edge 17 of reinforcement ring 14 defines a central opening or hole 18 which exposes a central surface 20 of base pad 12. Central surface 20 of base pad 12 may according to an example be impregnated with diamond particles or other abrasive materials. Central surface 20 of the base pad 12 may also be painted with a colour indicating a quality of the pad assembly 10, such as the coarseness. Base pad 12 and ring 14 preferably have circular peripheral surfaces 19 and 21, respectively.

In the example of FIGS. 15A and 15B, a plurality of abrasive tools or floor-contacting disks 16 are secured to the outer surface of the reinforcement ring 14. In the example shown, abrasive tools 16 are approximately 2-inch disks of diamond particles in a polymeric resin matrix. In the example shown, six such abrasive tools or disks 16 are secured about the circumference of reinforcement ring 14. Different sizes and different compositions of abrasive tools or disks 16 could be used. Tools or disks 16 are adhesively bonded to ring 14.

FIG. 15B shows base pad 12. Again, different base pads 12 could be used, but the example shown is a wear-resistant base pad 12 having a diameter of approximately 14 inches and a thickness of approximately one inch. A metal ring here constitutes the magnetic fastening means. The metal ring is glued to the upper surface of the tool. The ring has an outer diameter smaller than the outer diameter of the reinforcement ring 14.

To summarize, FIGS. 15A and 15B exemplify an abrasive tool 1500 comprising;

- a fibrous pad 12 including an upper surface, a floor-facing lower surface and a peripheral surface;
- a reinforcement layer 14 attached to the bottom surface of the pad, the reinforcement layer including an internal edge 17 defining a hole therethrough; abrasive disks 16 attached to a floor-facing surface of the reinforcement layer;
- a central area 20 of the pad being exposed through the hole of the reinforcement layer such that a linear dimension of the central area within the hole is greater than a linear dimension of one side of the reinforcement layer between the hole and a periphery thereof; and
- a magnetic ring 22 arranged on the upper surface which constitutes the magnetic fastening arrangement, wherein the magnetic ring has an outer diameter smaller than an outer diameter of the reinforcement layer 14.

The invention claimed is:

1. A tool driver for a power trowel, the tool driver comprising:

- a magnetic fastening arrangement comprising a tool driver fastening component that is configured to align with an abrasive tool fastening component of a complementary magnetic fastening arrangement of an abrasive tool to cause a first releasable holding of the abrasive tool to the tool driver; and
- a hook and loop based fastening arrangement configured to engage with a complementary hook and loop based fastening arrangement of the abrasive tool to cause a second releasable holding of the abrasive tool to the tool driver;
- wherein the magnetic fastening arrangement is configured symmetrically around a rotational center of the tool driver,
- wherein the hook and loop based fastening arrangement is adapted to provide increased shear strength during abrasive operation of the tool driver, and
- wherein the magnetic fastening arrangement is adapted to provide increased pull strength during lifting of the tool driver.

2. The tool driver according to claim 1, wherein the hook and loop based fastening arrangement comprises a material with hooks for holding respective loops on the abrasive tool.

3. The tool driver according to claim 1, wherein the magnetic fastening arrangement comprises a plurality of magnets arranged symmetrically around a rotational center of the tool driver.

4. The tool driver according to claim 1, wherein the magnetic fastening arrangement comprises a metal element responsive to a magnetic force from the abrasive tool.

5. The tool driver according to claim 1, wherein the tool driver comprises centering means for centering the abrasive tool with respect to the rotational center of the tool driver.

6. The tool driver according to claim 1, having a diameter between 7 and 25 inches.

7. The tool driver according to claim 1, wherein the hook and loop based fastening arrangement comprises a material with loops for holding respective hooks on the abrasive tool.

8. The tool driver according to claim 7, wherein the material with loops is a felt-like cloth, a fibrous material, a foam, rubber, and/or a non-synthetic material.

9. An abrasive tool for a power trowel, the abrasive tool comprising:

- a combination of:
  - a magnetic fastening arrangement comprising an abrasive tool fastening component that is configured to align with a tool driver fastening component of a complementary magnetic fastening arrangement of a tool driver of the power trowel to cause a first releasable holding of the abrasive tool to the tool driver; and
  - a hook and loop based fastening arrangement configured to engage a first side of the abrasive tool with a complementary hook and loop based fastening arrangement of the tool driver to cause a second releasable holding of the abrasive tool to the tool driver, wherein the magnetic fastening arrangement is configured symmetrically around a rotational center of the abrasive tool, wherein the hook and loop based fastening arrangement is adapted to provide increased shear strength during abrasive operation of the abrasive tool, and wherein the magnetic fastening arrangement is adapted to provide increased pull strength during lifting of the abrasive tool.

10. The abrasive tool according to claim 9, wherein the hook and loop based fastening arrangement comprises a material with hooks for holding respective loops on the tool driver.

11. The abrasive tool according to claim 9, wherein the magnetic fastening arrangement comprises a plurality of magnets arranged symmetrically around a rotational center of the abrasive tool.

12. The abrasive tool according to claim 9, wherein the magnetic fastening arrangement comprises a metal element responsive to a magnetic force from the tool driver.

13. The abrasive tool according to claim 9, wherein the abrasive tool comprises centering means for centering the abrasive tool with respect to a rotational center of the tool driver.

14. The abrasive tool according to claim 9, having a diameter between 7 and 25 inches.

15. The abrasive tool according to claim 9, wherein the magnetic fastening arrangement comprises a metal ring having a diameter smaller than an outer diameter of the abrasive tool.

16. The abrasive tool according to claim 9, wherein the hook and loop based fastening arrangement comprises a material with loops for holding respective hooks on the tool driver.

17. The abrasive tool according to claim 16, wherein the material with loops is a felt-like cloth, a fibrous material, and/or a non-synthetic material.

18. The abrasive tool according to claim 9, comprising an abrasive component or compound arranged on a second side of the abrasive tool opposite to the first side.

19. The abrasive tool according to claim 18, wherein the abrasive component is supported at least partly by a flexible supporting element.

20. An abrasive tool comprising:

a fibrous pad including an upper surface, a floor-facing lower surface, and a peripheral surface, the fibrous pad being configured to engage the upper surface with a hook and loop based fastening arrangement of a tool driver of a power trowel to cause a first releasable holding of the abrasive tool to the tool driver;

a reinforcement layer attached to the bottom surface of the pad, the reinforcement layer including an internal edge defining a hole therethrough;

abrasive disks attached to a floor-facing surface of the reinforcement layer;

a central area of the pad being exposed through the hole of the reinforcement layer such that a linear dimension of the central area within the hole is greater than a linear dimension of one side of the reinforcement layer between the hole and a periphery thereof; and a magnetic ring arranged on the upper surface, wherein the magnetic ring has an outer diameter smaller than an outer diameter of the reinforcement layer, the magnetic ring being configured to align with a tool driver fastening component of a magnetic fastening arrangement of the tool driver to cause a second releasable holding of the abrasive tool to the tool driver.

* * * * *